US009881504B2

(12) United States Patent
Dominic et al.

(10) Patent No.: US 9,881,504 B2
(45) Date of Patent: Jan. 30, 2018

(54) SYSTEM AND METHOD OF INTEGRATING DATA LINK MESSAGES WITH A FLIGHT PLAN

(71) Applicant: Honeywell International Inc., Morristown, NJ (US)

(72) Inventors: Maria John Paul Dominic, Karnataka (IN); Leonard Pereira, Karnataka (IN); Siva Kommuri, Karnataka (IN); Anil Kumar Pendyala, Burnsville, MN (US); Rakesh Kumar, Karnataka (IN); Xiaozhong He, Laurel, MD (US); Thomas D. Judd, Woodinville, WA (US); David Pepitone, Sun City West, AZ (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/334,568

(22) Filed: Jul. 17, 2014

(65) Prior Publication Data

US 2016/0019794 A1 Jan. 21, 2016

(51) Int. Cl.
*G06G 5/00* (2006.01)
*G08G 5/00* (2006.01)

(52) U.S. Cl.
CPC ..... *G08G 5/0013* (2013.01); *G08G 5/0021* (2013.01); *G08G 5/0052* (2013.01)

(58) Field of Classification Search
CPC .... B64C 19/00; B64C 39/024; G05D 1/0061; G05D 1/0088; G08G 5/04; G08G 5/0039;
(Continued)

(56) References Cited

U.S. PATENT DOCUMENTS 5,208,590 A 5/1993 Pitts
6,160,497 A 12/2000 Clark
(Continued)

FOREIGN PATENT DOCUMENTS

EP 2381433 10/2011
EP 2506237 10/2012
(Continued)

OTHER PUBLICATIONS

U.S. Patent and Trademark Office, "Office Action", "from U.S. Appl. No. 13/794,089", dated Oct. 10, 2014, pp. 1-28, Published in: US.

(Continued)

*Primary Examiner* — Nga X Nguyen
(74) *Attorney, Agent, or Firm* — Fogg & Powers LLC

(57) ABSTRACT

In one embodiment, an aerospace system is provided. The aerospace system comprises at least one display unit configured to display flight data and a memory configured to store one or more flight plan associations. Each flight plan association is an association between a data link message and a respective waypoint in a flight plan. The aerospace system also comprises a processing unit configured to determine when each respective waypoint in the flight plan is reached based on a comparison of current location data to the flight plan. When each respective waypoint is reached, the processing unit is configured to identify any data link messages associated with the respective waypoint based on the flight plan associations and to direct the at least one display unit to display a respective notification for each identified data link message associated with the respective waypoint.

20 Claims, 4 Drawing Sheets

(58) Field of Classification Search
CPC .. G08G 5/0034; G08G 5/0013; G08G 5/0021; G08G 5/0052; G08G 5/0047; G08G 5/0091; G01W 1/02; G01C 23/00
USPC ..... 701/484, 14–16, 1–3
See application file for complete search history.

(56) References Cited

U.S. PATENT DOCUMENTS

| | | | | |
|---|---|---|---|---|
| 6,661,353 | B1 | 12/2003 | Gopen | |
| 6,700,482 | B2 | 3/2004 | Ververs et al. | |
| 7,177,731 | B2 | 2/2007 | Sandell et al. | |
| 7,363,119 | B2 | 4/2008 | Griffin, III et al. | |
| 7,787,999 | B1 | 8/2010 | Barber | |
| 7,876,238 | B2 | 1/2011 | Vandenbergh et al. | |
| 8,195,347 | B2 | 6/2012 | Boorman | |
| 8,285,427 | B2 | 10/2012 | Rogers et al. | |
| 8,321,069 | B2 | 11/2012 | Vasek et al. | |
| 8,335,988 | B2 * | 12/2012 | Fahy | G06F 17/243 715/706 |
| 8,417,396 | B2 | 4/2013 | Goodman et al. | |
| 8,423,272 | B2 | 4/2013 | Judd et al. | |
| 8,560,148 | B2 | 10/2013 | Torres et al. | |
| 8,639,401 | B2 | 1/2014 | Bailey et al. | |
| 8,686,878 | B2 | 4/2014 | Whitlow et al. | |
| 8,760,319 | B2 * | 6/2014 | Kommuri | G08G 5/0013 340/945 |
| 9,132,913 | B1 | 9/2015 | Shapiro et al. | |
| 2003/0193408 | A1 | 10/2003 | Brown et al. | |
| 2003/0193411 | A1 | 10/2003 | Price | |
| 2005/0203676 | A1 | 9/2005 | Sandell et al. | |
| 2006/0129286 | A1 | 6/2006 | King | |
| 2007/0219679 | A1 | 9/2007 | Coulmeau | |
| 2011/0246053 | A1 | 10/2011 | Coulmeau et al. | |
| 2011/0264313 | A1 | 10/2011 | Sampath | |
| 2012/0191341 | A1 * | 7/2012 | Nara | G01C 21/36 701/420 |
| 2012/0215388 | A1 | 8/2012 | Pepitone et al. | |
| 2013/0080043 | A1 * | 3/2013 | Ballin | G08G 5/0034 701/120 |
| 2013/0085669 | A1 * | 4/2013 | Bailey | G08G 5/0039 701/467 |
| 2013/0249712 | A1 | 9/2013 | Buratto et al. | |
| 2014/0253585 | A1 * | 9/2014 | Paul Dominic | B64D 45/00 345/629 |
| 2014/0309821 | A1 | 10/2014 | Poux et al. | |
| 2014/0320417 | A1 | 10/2014 | Pakki et al. | |
| 2015/0002316 | A1 | 1/2015 | Sridhar et al. | |
| 2016/0019794 | A1 | 1/2016 | Dominic et al. | |
| 2016/0047674 | A1 | 2/2016 | Ramaiah et al. | |
| 2016/0161283 | A1 | 6/2016 | Shamasundar et al. | |

FOREIGN PATENT DOCUMENTS

| | | |
|---|---|---|
| WO | 2009046462 | 4/2009 |
| WO | 2011128835 | 10/2011 |

OTHER PUBLICATIONS

Adams et al, "Incorporating Data Link Messaging Into a Multi-Function Display for General Aviation Aircraft", "25th International Congress of the Aeronautical Sciences", 2006, pp. 1-9.

Baxley et al., "Use of Data Comm by Flight Crew in High-Density Terminal Areas", "American Institute of Aeronautics and Astronautics", Sep. 2010, pp. 1-14.

Mueller, "Experimental Evaluation of an Integrated Datalink and Automation-Based Strategic Trajectory Concept", "7th AIAA Aviation Technology, Integrated and Operations Conference", Sep. 18-20, 2007, pp. 1-15, Publisher: American Institute of Aeronautics and Astronautics.

U.S. Patent and Trademark Office, Office Action, U.S. Appl. No. 14/559,755, dated Apr. 19, 2016, pp. 1-41.

U.S. Patent and Trademark Office, "Final Office Action", From U.S. Appl. No. 14/559,755, dated Sep. 21, 2016, pp. 1-27, Published in: US.

United States Patent and Trademark Office, "Examiner's Answer", From U.S. Appl. No. 14/559,755, dated May 4, 2017, pp. 1-11, Published in: US.

United States Patent and Trademark Office, "Notice of Panel Decision from Pre-Appeal Brief Review", from U.S. Appl. No. 14/559,755, dated Feb. 15, 2017, pp. 1-2, Published in: US.

* cited by examiner

SYSTEM AND METHOD OF INTEGRATING DATA LINK MESSAGES WITH A FLIGHT PLAN

BACKGROUND

In flying an aircraft, pilots are often required to compose and send messages either to other systems on the aircraft or to systems on the ground. For example, pilots and air traffic controllers can communicate using Controller Pilot Data Link Communications (CPDLC) messages. In particular, situations arise where the pilot must request clearances or deviations to the flight plan due to weather, aircraft performance, or fuel constraint through CPDLC downlink request messages. A flight plan generally includes basic information such as, but not limited to, departure and arrival procedures, approach procedures, waypoints along the planned route that the aircraft will fly, alternate routes, estimated time en route, alternate airports, number of people on board, endurance and information about the aircraft itself. In general, different types of requests will be made to Air Traffic Control (ATC) through a CPDLC data link for clearances or deviations. These can include vertical clearances, crossing constraints, lateral route deviation, and speed changes. Additionally, messages and clearances can be received from the ground requiring action or response from the pilot.

SUMMARY

In one embodiment, an aerospace system is provided. The aerospace system comprises at least one display unit configured to display flight data and a memory configured to store one or more flight plan associations. Each flight plan association is an association between a data link message and a respective waypoint in a flight plan. The aerospace system also comprises a processing unit configured to determine when each respective waypoint in the flight plan is reached based on a comparison of current location data to the flight plan. When each respective waypoint is reached, the processing unit is configured to identify any data link messages associated with the respective waypoint based on the flight plan associations and to direct the at least one display unit to display a respective notification for each identified data link message associated with the respective waypoint.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
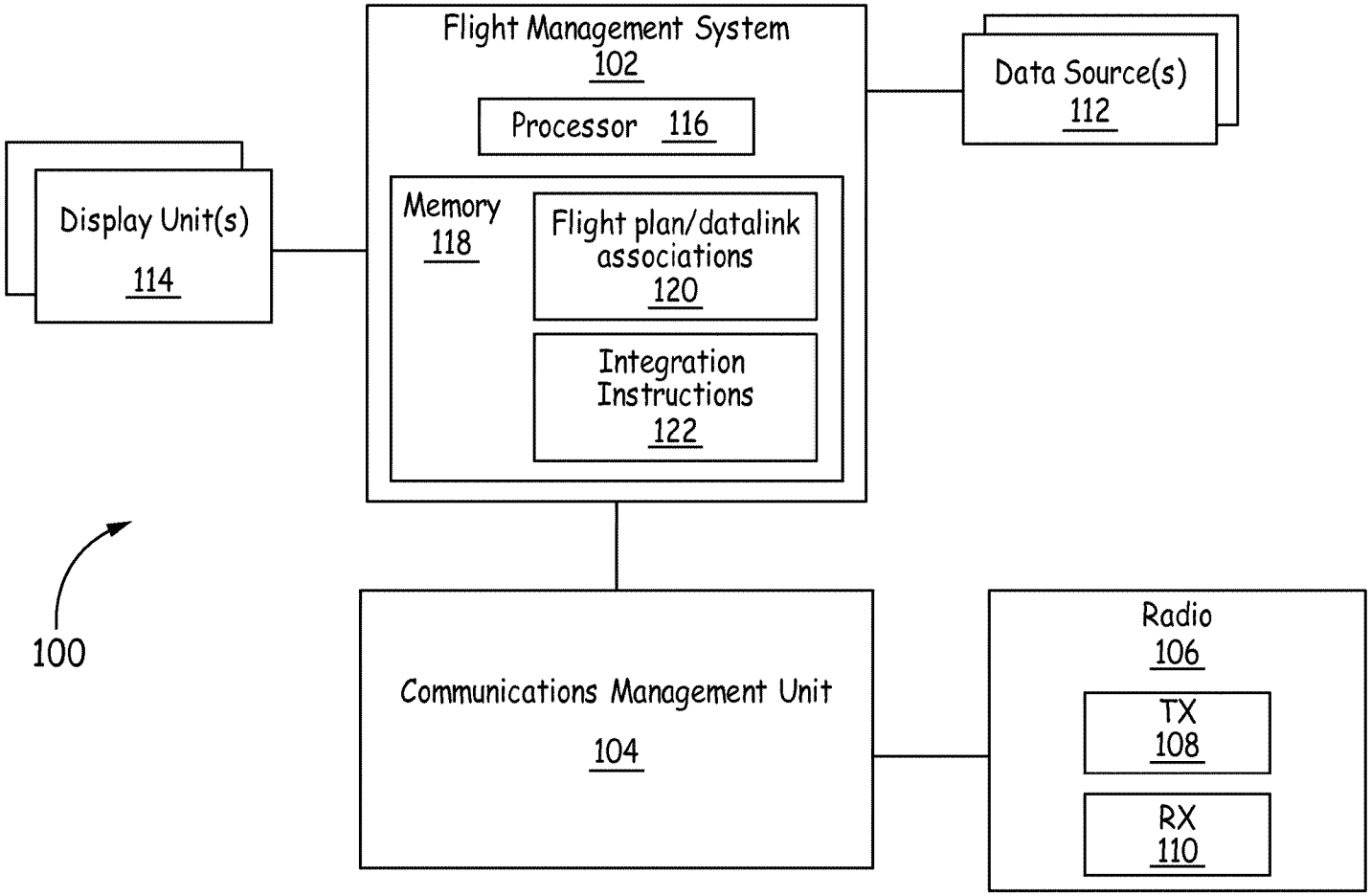
FIG. 1 is a high level block diagram of one embodiment of an exemplary aerospace system.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

FIG. 1 is a block diagram of one embodiment of an exemplary aerospace system 100. As used herein, the term "aerospace system" includes systems located on an aerospace vehicle as well as systems on the ground related to aerospace vehicles, such as systems used by an air traffic controller. The aerospace system 100 includes a flight management system 102 coupled to one or more data sources 112 and to one or more display units 114. As understood by one of skill in the art, the flight management system 102 is configured to process flight data from the one or more data sources 112 for display on the one or more display units 114 in order to provide the flight crew with information used for flying an aerospace vehicle, such as an aircraft.

The one or more data sources 112 can include, but are not limited to, a global positioning system (GPS) receiver, inertial navigation system (INS), weather radar, traffic collision avoidance system (TCAS), automatic dependent surveillance-broadcast system (ADS-B), a radar system such as weather radar, or other flight plan relevant sources of data. The one or more display units 114 can be implemented as, but are not limited to, a Multi-function Control and Display Unit (MCDU), a Multi-input Interactive Display Unit (MIDU), a Control Display Unit (CDU), a Vertical Situation Display (VSD), a Head's Up Display (HUD), a Near-to-Eye (NTE), a Multi-Function Display (MFD) associated with a Communication Management Unit (CMU) 104 and/or the FMS 102, or any other avionic display unit available to a flight crew. The display 114 can be associated with a primary flight display (PFD) or an engine-indicating and crew-alerting system (EICAS) display. Suitable technologies for implementing the display unit 114 include, but are not limited to, a cathode ray tube (CRT) display, an active matrix liquid crystal display (LCD), a passive matrix LCD, or plasma display 114.

In addition to the conventional functionality of processing flight data for display on a display unit, the FMS 102 in this exemplary system is configured to integrate data link messages with respective locations in a flight plan. As used herein, a data link message is a communication between a member of a flight crew on an aerospace vehicle and ground (e.g. Air Traffic Control (ATC)). Data link communications can include, for example, Future Air Navigation System (FANS) Controller Pilot Data Link Communications (CPDLC) messages, Aeronautical Telecommunications Network (ATN) Protected Mode CPDLC messages (PM CPDLC), Flight Information Service (FIS) communications, CMU/Communications Management Function (CMF) Airline Operations Center (AOC) communications, Aeronautical Radio, Incorporated (ARINC) 623 Air Traffic Services, and Flight Management Computer (FMC) AOC data link messages. Additionally, as used herein, the term 'downlink' refers to messages transmitted to a ground station and the term 'uplink' refers to a message transmitted to the aerospace vehicle.

The correlation or association of data link messages with locations in a flight plan can be preconfigured prior to a flight and/or dynamically created during flight, such as when uplink data link messages are received. Additionally, the associations can be created automatically or under direction from a user based on user input. For example, in some embodiments, an airline can pre-configure one or more downlink data link messages and corresponding waypoints in a flight plan. Thus, the associations are loaded into the FMS 102 with the flight plan in such embodiments. The FMS 102 then stores the flight plan/data link associations 120 in memory 118. In some embodiments, the flight plan/data link associations 120 are created based on user input from a pilot, for example. In such embodiments, a user can input information through prompts on a display unit 114 to associate a future downlink data link message with a location or waypoint in the flight plan. As used herein, the term 'waypoint' is defined to mean a set of coordinates that identify a point in physical space along a route or path. The user can input the information prior to take-off and/or during flight. In addition, in some embodiments, the flight plan/data link associations 120 are generated automatically based on received uplink data link messages.

For example, an uplink message received via the receiver 110 in radio 106 is passed to the FMS 102 via the communications management unit 104. The FMS 102 decodes the uplink message. For example, if the uplink message requests a downlink response or report at a certain location, time, and/or waypoint, the FMS 102 associates the requested downlink with the specified location, time, waypoint, etc. In particular, the FMS 102 is configured with terms such as "waypoint," "climb", "maintain," etc. as well as data associated with the recognized words, such as the name of a specific waypoint or an altitude, etc. The FMS 102 then generates and stores a flight plan/data link association 120 based on the identified information from the decoded uplink message. As one non-limiting example, an uplink message could contain "Report Reaching FL370 . . . then send DL Altitude Report when FL370 is reached." In such an example, the FMS 102 could create a flight plan/data link association for reporting when the aircraft is reaching the waypoint FL370 and a flight plan/data link association for sending the downlink Altitude Report once the waypoint FL370 is reached.

Figure 2:
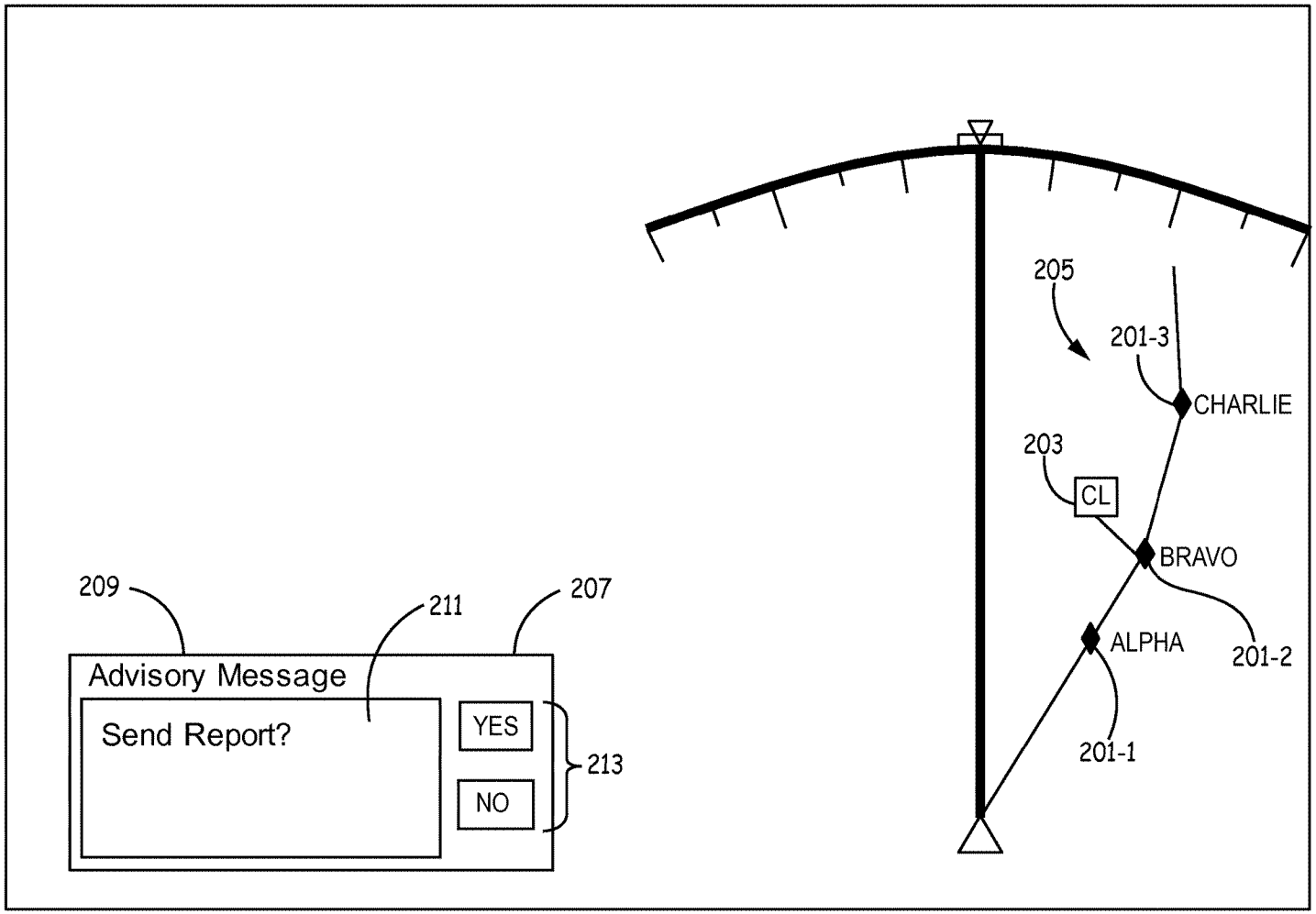
FIG. 2 is a diagram of one embodiment of an exemplary flight display including a notification of an associated data link message.

The FMS 102 is configured to provide notifications to a pilot/user based on the stored flight plan/data link associations 120. For example, in some embodiments, the FMS 102 causes an icon or flag to be displayed on a depiction of the flight plan, as shown in the example of FIG. 2. In particular, FIG. 2 depicts three waypoints 201 of an exemplary flight plan 205. As shown in FIG. 2, a flag 203 is associated with the waypoint 201-2. The flag 203 indicates that an association exists between waypoint 201-2 and a clearance request. Thus, the flag 203 provides a visual reminder to a pilot of a future clearance request to be made at waypoint 201-2. In some embodiments, the pilot can select the flag 203 to display the complete information for the clearance request.

In addition to, or in lieu of, displaying a flag on a flight plan, the FMS 102 is configured, in some embodiments, to provide notifications to a pilot when a corresponding location in the flight plan is reached. For example, when each waypoint is reached in the flight plan, the FMS 102 checks to determine if there is a data link message associated with the respective waypoint. The FMS 102 then directs one or more display units 114 to display a notification to the pilot for each data link message associated with the respective waypoint.

An exemplary pop-up notification 207 is depicted in FIG. 2. The notification 207 can be overlaid on top of other displayed graphics. The notification 207, in this example, includes a title section 209 indicating that the exemplary notification is an advisory message. Additionally, the notification 207, in this example, includes a message section 211 containing information or requests for the pilot and a response section 213 which provides options for the pilot to respond to the notification 207. For example, in FIG. 2, the message section displays the question "Send Report?" and the response section 213 includes the options/prompts "yes" and "no". It is to be understood that FIG. 2 is presented by way of example only. In particular, each notification 207 may include different options. For example, rather than displaying a generic message, such as "Send Report?", in message section 211, a more specific message can be included, such as "Send Altitude Report Downlink?" or "Send Altitude Request for FL370?". Additionally, some notifications may not require a response and, therefore, do not include a response section 213. In other examples, the response section 213 can include other options, such as "postpone" or "delay" until a specified future waypoint or time period. Additionally, in lieu of the options "yes" and "no," the terms "send" and "discard" are used in other embodiments. Thus, it is to be understood that the notification 207 in FIG. 2 is provided by way of example only.

Figure 3:
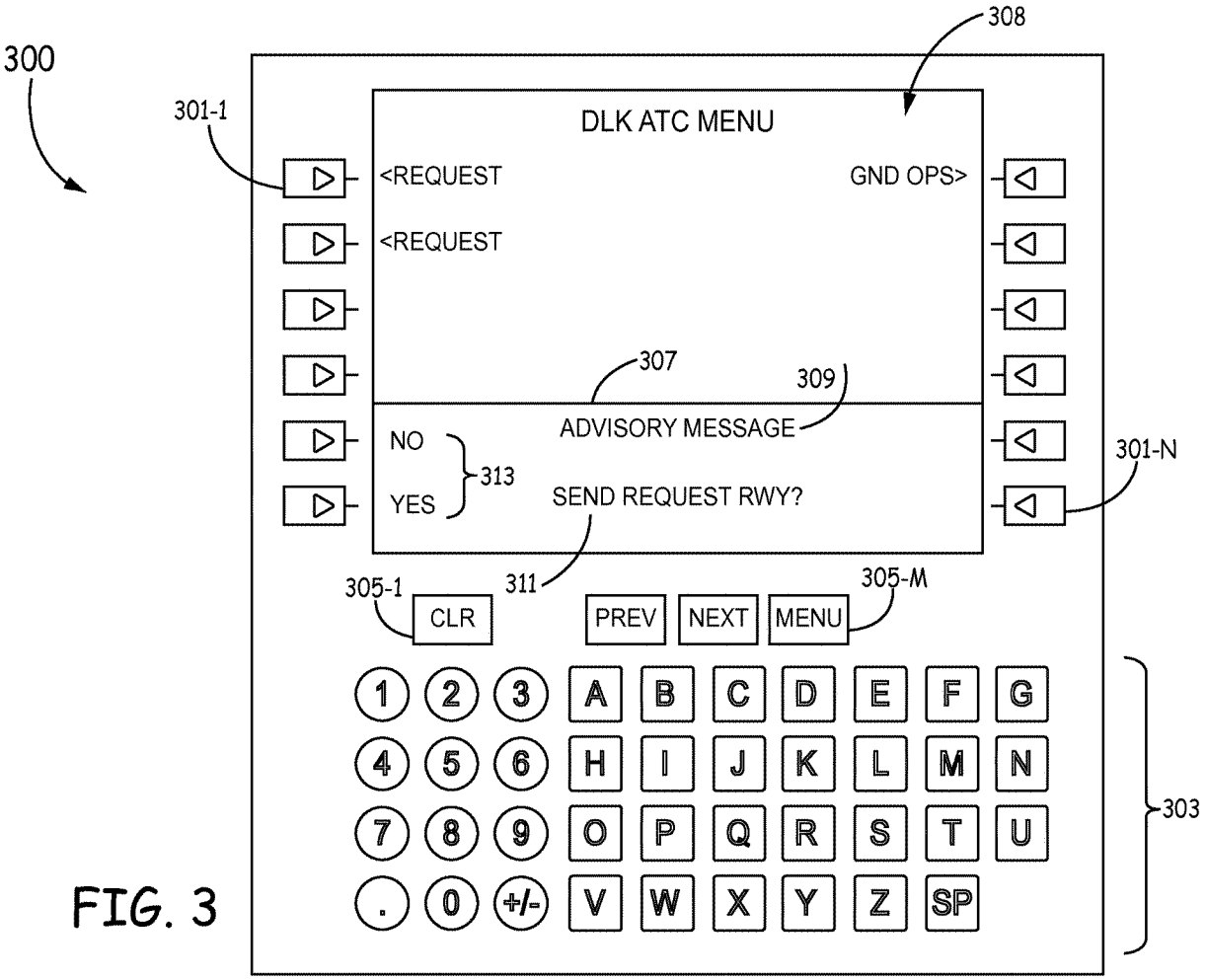
FIG. 3 is a diagram of another embodiment of an exemplary flight display including a notification of an associated data link message.

In addition, in some embodiments, the FMS 102 directs the display of a notification on a text-only display, such as is shown in FIG. 3, in addition to or in lieu of a notification on a graphical display such as is shown in FIG. 2. FIG. 3 depicts an exemplary text-based multi-function control display unit (MCDU) 300. The exemplary MCDU 300 includes pre-defined function buttons 305-1 . . . 305-M, modifiable or custom buttons 301-1 . . . 301-N (also referred to as line select buttons), and alpha-numeric keypad 303. The pre-defined function buttons 305-1 . . . 305-M are buttons which are permanently associated with a particular functionality, such as moving to the next or previous page, displaying a menu, etc. The custom buttons 301-1 . . . 301-N are buttons which are associated with different functions depending on the message or information displayed on the display 308. In some embodiments, the pre-defined buttons 305-1 . . . 305-M, action buttons 301-1 . . . 301-N, and/or alpha-numeric keypad 303 are implemented as buttons or icons on touch-screen technology rather than as physical buttons separate from the display 308. In addition, it is to be understood that other user input device can be used in other embodiments, such as, but not limited to, keyboards, microphones, cursor control devices, etc.

As shown in FIG. 3, a segment of the text area of the MCDU is used to provide the notification 307. Similar to the notification 207 in FIG. 2, the notification 307 includes a title 309, a message or request 311, and response options 313. In this example, a pilot is able to enter a selected response using the line select button 301 associated with the desired response. It is to be understood, that the notification 307 is presented by way of example only. For example, in other embodiments, the response options 313, title 309, and/or message 311 can vary for each respective data link message. Additionally, it is to be understood that a notification can be provided on more than one display simultaneously. For example, a notification can be displayed simultaneously on a MCDU and on a vertical situation display.

Through the use of flags and/or notifications based on flight plan/data link associations 120, as discussed above, the cognitive or memory burden on a pilot for creating or responding to future data link messages is reduced. In particular, in conventional aerospace systems, a pilot needs to use data/input from other aircraft systems to know the proper timing and location to send downlink messages for various requests/reports and other information. Thus, the pilot needs to remember which specific actions should be taken for a particular time and location. This can lead to non-compliance to clearances and/or procedures if the pilot does not take the required action at the correct time. However, the aerospace system 100 alleviates this burden by associating data link messages with a location in the flight plan and providing visual reminders of when specific actions are to be taken.

In addition, in some embodiments, the burden placed on a flight crew is further reduced by enabling the flight crew to navigate directly from the notifications to a respective downlink message screen. For example, in some embodiments, when a pilot selects 'yes' in the response section of the notification, the FMS 102 causes the corresponding downlink message verification system to be displayed. Thus, the FMS 102 populates the downlink message with the relevant information and the pilot is presented with the downlink message for review prior to sending the downlink message via the CMU 104 and radio 106 to a ground station. In other embodiments, the message is not pre-populated and a corresponding message composition screen is displayed when the option to send the downlink message is selected on the response section of the corresponding notification. In the embodiments described herein, the pilot's head down time is reduced as compared to conventional systems.

For example, the pilot's head down time in a conventional system is increased due to gathering data from other aircraft systems to determine the time and location for taking specific actions and due to navigating to different screens to send the corresponding messages. However, in the embodiments described herein, the aerospace system 100 reminds/advises the pilot as to the time and location for taking specific actions or sending data link messages. In addition, the aerospace system 100 enables the pilot to navigate directly to the corresponding message composition screen or message verification screen without the need to traverse the conventional hierarchal menu structure to select the corresponding message screen. Hence, as compared to conventional systems, the pilot's head down time is reduced through the use of aerospace system 100.

The functionality described herein with respect to integrating data link messages with locations in a flight plan can be implemented as software instructions, such as integration instructions 127, configured to cause a processor, such as processor 116, to perform the functionality described above.

These instructions are typically stored on any appropriate computer readable medium used for storage of computer readable instructions or data structures. The computer readable medium can be implemented as any available media that can be accessed by a general purpose or special purpose computer or processor, or any programmable logic device. Suitable processor-readable media may include storage or memory media such as magnetic or optical media. For example, storage or memory media may include conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc. Suitable processor-readable media may also include transmission media such as electrical, electromagnetic, or digital signals, conveyed via a communication medium such as a network and/or a wireless link.

It is to be understood that the system 100 described above is provided by way of example only and not by way of limitation. For example, in some embodiments, all or part of the functionality in the flight management system 102 to integrate the data link messages with locations in a flight plan, as described above, can be implemented in another avionics computer, such as the communications management unit 104.

Figure 4:
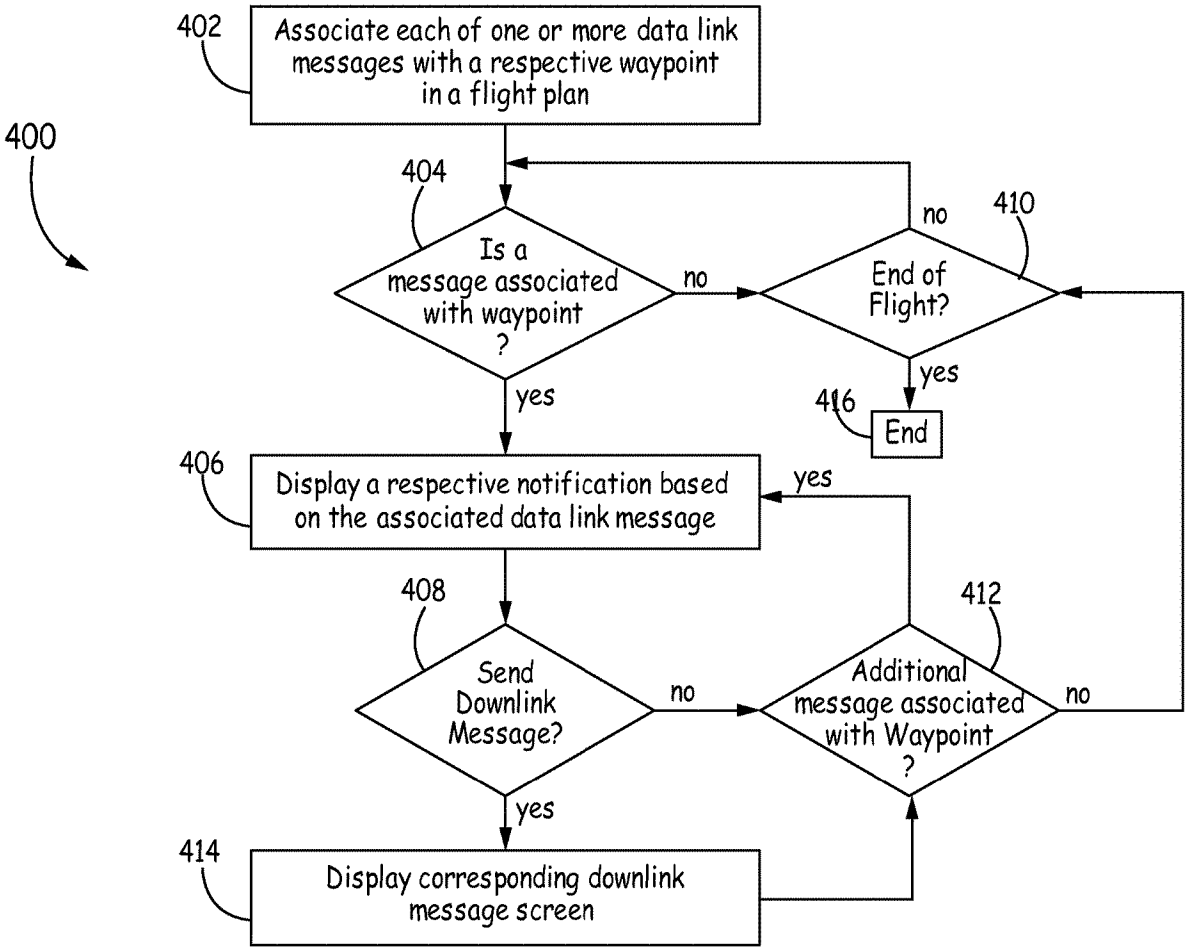
FIG. 4 is a flow chart depicting one embodiment of an exemplary method of integrating data link messages with a flight plan.

FIG. 4 is a flow chart depicting one embodiment of a method 400 of integrating data link messages with a flight plan. Method 400 can be implemented by an aerospace system, such as system 100 described above. At block 402, each of one or more data link messages is associated with a respective one or more waypoints in a flight plan. It should be noted that more than one data link message can be associated with the same location or waypoint in the flight plan. In addition, it is to be understood that associating a data link message with a waypoint can include associating a reminder/notification that is related to the data link message with the waypoint. For example, if a response to an uplink data link message is required at a future point in the flight plan, a notification based on the uplink data link message can be created to remind the pilot to provide the required response at the specified point in the flight plan. Similarly, if a request for clearance or other action is to be taken at a future point in the flight plan, a notification can be created to remind the pilot to take the specified action at the specified point in the flight plan. In addition, associating a data link message with a waypoint includes setting a longitudinal distance from the waypoint to determine when the waypoint has been reached for purposes of that respective data link message.

In some embodiments, the one or more data link messages are preconfigured to be associated with a respective waypoint by an airline, as discussed above. Additionally, in some embodiments, associating the data link messages with a location in a flight plan involves receiving input data from a pilot either prior to or during a flight. Furthermore, in some embodiments, the one or more data link messages are automatically associated with a location in the flight plan based on recognized keywords or terms in the data link message, as discussed above.

At block 404, it is determined if at least one of the one or more data link messages is associated with the respective current waypoint. For example, data can be obtained regarding the current location of the aerospace vehicle from sensors onboard the aerospace vehicle, such as inertial measurement units, global positioning system (GPS) receivers, etc. The current location is then compared to the flight plan to determine when each waypoint is reached. As noted above, determining that a waypoint has been reached can include comparing the current location with a specified distance from the waypoint. When each waypoint is reached, it is determined if an association exists between one of the data link messages and the current respective waypoint. If a data link message is not associated with the current waypoint, it is determined at block 410 if the end of the flight has been reached. If the end of the flight has not been reached, method 400 returns to block 404 to determine if a data link message is associated with the next waypoint when it is reached. Thus, when each respective waypoint in the flight plan is reached, it is determined if at least one of the one or more data link messages is associated with the respective waypoint.

If a data link message is associated with the current respective waypoint, a respective notification based on the associated data link message is displayed at block 406. For example, the notification can be displayed on a graphical display and/or a text-only display. In particular, in some embodiments, the notification is displayed simultaneously on a plurality of avionic displays. In other embodiments, the notification is only displayed on a single avionic display.

At block 408, it is determined if a downlink data link message is to be sent based on user input. For example, in some embodiments, the displayed notification include prompts for user input to take action based on the respective notification, such as sending a response, report, or request. If a downlink data link message is not being sent, method 400 continues to block 412 where it is determined if another data link message is associated with the current waypoint. If an additional data link message is associated with the current waypoint, a corresponding notification is displayed on one or more display units at block 406. At block 408, it is determined if a downlink data link message related to the additional data link message is to be sent.

If it is determined, at block 408, that a downlink data link message is to be sent, a corresponding downlink message screen is displayed at block 414. For example, in some embodiments, if the pilot selects to send a downlink message via the prompts presented in the displayed notification, a downlink message verification screen is displayed. That is the downlink message verification screen is pre-populated with the data to be sent and the pilot is able to review and then send the pre-populated message. If a change needs to be made, the pilot can select to view the corresponding message composition screen and update the message data. In other embodiments, a downlink message composition screen is displayed in response to the pilot selection received via the prompts in the related notification. The downlink message composition screen includes fields which enable the pilot to enter the required data to compose the message. The composed message is then reviewed on a verification screen from which the downlink data link message is sent.

After the downlink data link message is sent, method 400 proceeds to block 412 where it is determined if another data link message is associated with the current waypoint. If no further data link messages are associated with the current waypoint, it is determined if the end of the flight has been reached at block 410. If the end of the flight has not been reached, method 400 returns to block 404 to determine if a data link message is associated with the next waypoint in the flight plan. If the end of the flight has been reached, the method ends at block 416.

EXAMPLE EMBODIMENTS

Example 1 includes an aerospace system comprising: at least one display unit configured to display flight data; a memory configured to store one or more flight plan associations, wherein each flight plan association is an association between a data link message and a respective waypoint in a flight plan; and a processing unit configured to determine when each respective waypoint in the flight plan is reached based on a comparison of current location data to the flight plan; wherein, when each respective waypoint is reached, the processing unit is configured to identify any data link messages associated with the respective waypoint based on the flight plan associations and to direct the at least one display unit to display a respective notification for each identified data link message associated with the respective waypoint.

Example 2 includes the aerospace system of Example 1, wherein the at least one display unit comprises a plurality of display units, wherein the processing unit is configured to cause each of the plurality of display units to display the respective notification for each identified data link message.

Example 3 includes the aerospace system of any of Examples 1-2, wherein the at least one display unit comprises one or more of a Multi-function Control and Display Unit (MCDU), a Multi-input Interactive Display Unit (MIDU), a Vertical Situation Display (VSD), a Multi-Function Display (MFD) associated with a Communication Management Unit (CMU) or a Flight Management System (FMS).

Example 4 includes the aerospace system of any of Examples 1-3, wherein the processing unit is configured to analyze received uplink data link messages to identify terms and to generate the one or more flight plan associations based on the identified terms.

Example 5 includes the aerospace system of any of Examples 1-4, wherein the aerospace system includes a user input device configured to receive input from a user, wherein the one or more flight plan associations are generated based on input received via the user input device.

Example 6 includes the aerospace system of any of Examples 1-5, wherein the aerospace system includes a user input device configured to receive input from a user, wherein the processing unit is configured to direct the at least one display unit to display a downlink message screen in response to input from a user via options presented in the respective displayed notification.

Example 7 includes the aerospace system of any of Examples 1-6, wherein the one or more flight plan associations are pre-configured and loaded into a flight computer with the flight plan prior to a flight.

Example 8 includes a method of integrating data link messages with a flight plan, the method comprising: associating each of one or more data link messages with a respective one or more waypoints in the flight plan; when each respective waypoint in the flight plan is reached, determining if at least one of the one or more data link messages is associated with the respective waypoint; and for each data link message associated with the respective waypoint, displaying a respective notification based on the associated data link message.

Example 9 includes the method of Example 8, wherein associating each of the one or more data link messages with the respective one or more waypoints in the flight plan includes: pre-configuring associations between the one or more data link messages and the respective one or more waypoints; and uploading the preconfigured associations to a flight computer with the flight plan.

Example 10 includes the method of any of Examples 8-9, wherein associating each of the one or more data link messages with the respective one or more waypoints in the flight plan includes: analyzing received uplink data link messages to identify terms; and generating one or more associations between the one or more data link messages and the respective one or more waypoints based on the identified terms.

Example 11 includes the method of any of Examples 8-10, wherein associating each of the one or more data link messages with the respective one or more waypoints in the flight plan includes associating each of the one or more data link messages with the respective one or more waypoints based on data input by a pilot.

Example 12 includes the method of any of Examples 8-11, wherein displaying the respective notification includes displaying prompts for user input to take action based on the respective notification.

Example 13 includes the method of Example 12, further comprising displaying a downlink message screen in response to user input received via the displayed prompts.

Example 14 includes the method of Example 13, wherein displaying the downlink message screen comprises displaying a downlink message verification screen, the downlink message verification screen automatically populated with data corresponding to the downlink message.

Example 15 includes the method of any of Examples 13-14, further comprising displaying an icon with a respective waypoint on a graphical depiction of the flight plan, the icon indicating that an association exists between one of the one or more data link messages and the respective waypoint.

Example 16 includes a program product comprising a processor-readable medium on which program instructions are embodied, wherein the program instructions are configured, when executed by at least one programmable processor, to cause the at least one programmable processor to: determine when each respective waypoint in a flight plan is reached based on a comparison of current location data to the flight plan; when each respective waypoint is reached, identify any data link messages associated with the respective waypoint; and direct at least one display unit to display a respective notification for each identified data link message associated with the respective waypoint.

Example 17 includes the program product of Example 16, wherein the program instructions are further configured to cause the at least one programmable processor to direct the at least one display unit to display an icon with a respective waypoint on a graphical depiction of the flight plan, the icon indicating that an association exists between a data link message and the respective waypoint.

Example 18 includes the program product of any of Examples 16-17, wherein the program instructions are further configured to cause the at least one programmable processor to: analyze received uplink data link messages to identify terms; and generate one or more flight plan associations based on the identified terms, wherein each flight plan association is an association between a data link message and a respective waypoint in a flight plan.

Example 19 includes the program product of any of Examples 16-18, wherein the program instructions are further configured to cause the at least one programmable processor to direct each of a plurality of display units to display simultaneously the respective notification for each identified data link message associated with the respective waypoint.

Example 20 includes the program product of any of Examples 16-19, wherein the program instructions are further configured to cause the at least one programmable processor to direct the at least one display unit to display a downlink message screen in response to input from a user via options presented in the respective displayed notification.

Although the embodiments described above are directed at the generation and transmission of downlink messages from an aircraft to the ground, it is to be understood that the above techniques can be applied to uplink messages from the ground to an aircraft. For example, the method of FIG. 4 can be adapted to create flight plan/data link associations for uplink messages with respect to specific aircraft. Thus, the method 400 can be used to aid an air traffic controller in communicating with and monitoring aircraft. Hence, although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An aerospace system comprising:

a first display unit onboard an aircraft and configured to display flight data including a graphical depiction of a flight plan;

a second display unit onboard the aircraft and physically separate from the first display unit, wherein the second display unit is a text-only display unit configured to display data link messages;

a memory configured to store one or more flight plan associations, wherein each flight plan association is an association between a data link message and a respective waypoint in the flight plan; and a processing unit configured to identify any data link messages associated with the respective waypoint based on the flight plan associations and to direct the first display unit to display a respective notification for each identified data link message associated with the respective waypoint on the graphical depiction of the flight plan to provide a visual reminder to a pilot that a particular data link message is applicable when the respective waypoint is reached;

wherein the second display unit is configured to display a corresponding downlink message screen when the respective waypoint is reached and a datalink message is to be sent.

2. The aerospace system of claim 1, wherein the processing unit is configured to cause each of the first and second display units to display the respective notification for each identified data link message.

3. The aerospace system of claim 1, wherein each of the first and second display units comprises a Multi-function Control and Display Unit (MCDU), a Multi-input Interactive Display Unit (MIDU), a Vertical Situation Display (VSD), or a Multi-Function Display (MFD) associated with a Communication Management Unit (CMU) or a Flight Management System (FMS).

4. The aerospace system of claim 1, wherein the processing unit is configured to analyze received uplink data link messages to identify terms and to generate the one or more flight plan associations based on the identified terms.

5. The aerospace system of claim 1, wherein the aerospace system includes a user input device configured to receive input from a user, wherein the one or more flight plan associations are generated based on input received via the user input device.

6. The aerospace system of claim 1, wherein the aerospace system includes a user input device configured to receive input from a user, wherein the processing unit is configured to direct the second display unit to display the corresponding downlink message screen in response to input from a user via options presented in the respective displayed notification.

7. The aerospace system of claim 1, wherein the one or more flight plan associations are pre-configured and loaded into a flight computer with the flight plan prior to a flight.

8. A method of integrating data link messages with a flight plan, the method comprising:

associating each of one or more data link messages with a respective one or more waypoints in the flight plan;

displaying flight data including a graphical depiction of the flight plan on a first display unit onboard an aircraft;

for each data link message associated with a respective waypoint, displaying a respective notification associated with the respective waypoint on the graphical depiction of the flight plan to provide a visual reminder to a pilot that a particular data link message is applicable when the respective waypoint is reached; and displaying a corresponding downlink message screen on a second display unit, which is onboard the aircraft and physically separate from the first display unit, when the respective waypoint is reached and a datalink message is to be sent;

wherein the second display unit is a text-only display unit configured to display data link messages.

9. The method of claim 8, wherein associating each of the one or more data link messages with the respective one or more waypoints in the flight plan includes:

pre-configuring associations between the one or more data link messages and the respective one or more waypoints; and uploading the preconfigured associations to a flight computer with the flight plan.

10. The method of claim 8, wherein associating each of the one or more data link messages with the respective one or more waypoints in the flight plan includes:

analyzing received uplink data link messages to identify terms; and generating one or more associations between the one or more data link messages and the respective one or more waypoints based on the identified terms.

11. The method of claim 8, wherein associating each of the one or more data link messages with the respective one or more waypoints in the flight plan includes associating each of the one or more data link messages with the respective one or more waypoints based on data input by a user.

12. The method of claim 8, wherein displaying the respective notification includes displaying prompts for user input to take action based on the respective notification.

13. The method of claim 12, wherein displaying the corresponding downlink message screen is in response to user input received via the displayed prompts.

14. The method of claim 13, wherein displaying the corresponding downlink message screen comprises displaying a downlink message verification screen, the downlink message verification screen automatically populated with data corresponding to the downlink message.

15. The method of claim 13, wherein displaying the respective notification comprises displaying an icon with the respective waypoint on the graphical depiction of the flight plan, the icon indicating that an association exists between one of the one or more data link messages and the respective waypoint.

16. A program product comprising a non-transitory processor-readable medium on which program instructions are embodied, wherein the program instructions are configured, when executed by at least one processor, to cause the at least one processor to:

associate each of one or more data link messages with a respective one or more waypoints in a flight plan;

display flight data including a graphical depiction of the flight plan on a first display unit onboard an aircraft;

for each data link message associated with a respective waypoint, display a respective notification associated with the respective waypoint on the graphical depiction of the flight plan to provide a visual reminder to a pilot that a particular data link message is applicable when the respective waypoint is reached; and display a corresponding downlink message screen on a second display unit, which is onboard the aircraft and physically separate from the first display unit, when the respective waypoint is reached and a datalink message is to be sent;

wherein the second display unit is a text-only display unit configured to display data link messages.

17. The program product of claim 16, wherein the display of the respective notification comprises a display of an icon with the respective waypoint on the graphical depiction of the flight plan, the icon indicating that an association exists between a data link message and the respective waypoint.

18. The program product of claim 16, wherein the program instructions are further configured to cause the at least one processor to:

analyze received uplink data link messages to identify terms; and generate one or more flight plan associations based on the identified terms, wherein each flight plan association is an association between a data link message and a respective waypoint in the flight plan.

19. The program product of claim 16, wherein the program instructions are further configured to cause the at least one processor to direct each of the first and second display units to display simultaneously the respective notification for each data link message associated with the respective waypoint.

20. The program product of claim 16, wherein the program instructions are further configured to cause the at least one processor to direct the second display unit to display the corresponding downlink message screen in response to input from a user via options presented in the respective displayed notification.

* * * * *